United States Patent [19]

Barten

[11] Patent Number: 5,006,754

[45] Date of Patent: Apr. 9, 1991

[54] COLOR DISPLAY TUBE WITH MAGNETIC FIELD SHAPING PLATES

[75] Inventor: Piet G. J. Barten, Eindhoven, Netherlands

[73] Assignee: U.S. Philips Corporation, New York, N.Y.

[21] Appl. No.: 851,282

[22] Filed: Apr. 10, 1986

Related U.S. Application Data

[63] Continuation of Ser. No. 548,276, Nov. 3, 1983, abandoned.

[30] Foreign Application Priority Data

Nov. 18, 1982 [NL] Netherlands ..... 8204465

[51] Int. Cl.[5] ..... H01J 29/51; H01J 29/76

[52] U.S. Cl. ..... 313/412; 313/413; 313/414; 313/431

[58] Field of Search ..... 313/412, 413, 414, 431

[56] References Cited

U.S. PATENT DOCUMENTS

| | | | |
|---|---|---|---|
| Re. 29,895 | 1/1979 | Murata et al. | 313/412 X |
| 3,860,850 | 1/1975 | Takenaka et al. | 313/431 X |
| 4,057,747 | 11/1977 | Hamano | 313/414 X |
| 4,377,767 | 3/1983 | Kornaker | 313/412 |

FOREIGN PATENT DOCUMENTS

| | | | |
|---|---|---|---|
| 187844 | 11/1982 | Japan | 313/414 |

*Primary Examiner*—Palmer C. DeMeo
*Attorney, Agent, or Firm*—Robert J. Kraus

[57] ABSTRACT

In a color display tube of the so-called "in-line" type, the magnetic field which extends substantially parallel to the plane through the beam axes is distorted so as to be locally pincushion-shaped by means of field shapers at the end of the electron gun system. This effects coma correction for the rasters produced by the three electron beams at the display screen, without causing substantial deflection defocusing of the side beams.

10 Claims, 3 Drawing Sheets

COLOR DISPLAY TUBE WITH MAGNETIC FIELD SHAPING PLATES

This is a continuation of application Ser. No. 548,276, filed 3 Nov. 1983 now abandoned.

BACKGROUND OF THE INVENTION

The invention relates to a colour display tube comprising in an evacuated envelope an electron gun system of the "in-line" type for generating three electron beams situated with their axes in one plane, the axis of the central beam coinciding with the tube axis. The electron beams converge on a display screen provided on a wall of the envelope and in the operating display tube are deflected over the display screen in two mutually perpendicular directions by means of a first and a second deflection field. The direction of the first deflection field is parallel to the plane and the electron gun system comprises at its end field shapers for causing the rasters written on the display screen by the electron beams to coincide as much as possible.

Such a colour display tube is disclosed in U.S. Pat. No. 4,196,370. A frequently occurring problem in colour display tubes having an electron gun system of the "in-line" type is coma, meaning that the dimensions of the rasters which are written on the display screen by the three electron beams are different. This is the result of the eccentric location of the outermost electron beams relative to the vertical deflection field (the frame deflection field). In the patent specification a large number of patents are mentioned in which partial solutions are given. These solutions consist of using magnetic field conducting and/or screening rings and plates which are mounted at the end of the gun and which intensify or weaken the deflection field or the deflection fields locally along a part of the paths of the electron beams. With a number of these means it is possible to cause the rasters written on the display screen by the three electron beams to coincide substantially. A disadvantage of the use of such means, however, is that defocusing occurs in the outermost beams during deflection which is expressed in a distorted spot on the display screen which is surrounded by a haze. One of the patents is U.S. Pat. No. 3,594,600 which describes a colour display tube in which the rasters written by the three electron beams are made to coincide by placing two elongate C-shaped magnetic screens beyond the outermost electron beams. As a result of this the outermost electron beams are screened from the edge field of the line deflection field (the vertical field lines) while the edge field is admitted to the central electron beam. The three electron beams are screened from the edge field of the frame deflection field (the horizontal field line) which is guided entirely around the three beams. Thus these field shapers influence the line coma and not the field coma.

In Netherlands Patent Application No. 7801317, corresponding to U.S. Pat. No. 4,237,437, a system of deflection coils is described in which field-forming means are provided in the system of deflection coils. They consist, for example, of two soft magnetic elements which are provided diametrically opposite to each other beyond the line deflection coil, substantially transversely to the magnetic field of the frame deflection coil on the side of the neck of the system of deflection coils. A disadvantage of the use of such field-forming means is that a large part of the frame deflection field is distorted by the field-forming elements, which consume substantial deflection energy.

SUMMARY OF THE INVENTION

It is therefore an object of the invention to provide means with which the rasters written on the display screen by the three electron beams coincide substantially, with which considerably less deflection defocusing of the side beams occurs and in which little extra deflection enegy is necessary.

For that purpose, a colour display tube of the kind mentioned in the opening paragraph is characterized according to the invention in that the field shapers consist of at least two curved plates of a ferromagnetic material, which plates are situated symmetrically with respect to the plane and the central beam axis and face the three beams with their concave sides. The field shapers cause the edge field of the first deflection field to be pincushion-shaped, which pincushion-shaped field comprises substantially a bipolar field having a six-pole component.

The invention is based on the recognition of the fact that the known field shapers provided at the end of the gun adapt the field strength of the deflection field for the three beams so that it is correct on the axis of each beam. However, the field in the area of electrons in each outer beam situated away from the axis does not have the correct strength and shape, which results in a quadrupole component in the field at the area of each outer beam. As a result of this, the rasters written by the three electron beams do coincide, but the quadrupole component causes defocusing of the outer beams upon deflection. By using field shapers as used in the tube according to the invention the field is distorted so that also at the area of electrons in the outer beams situated beyond away from the axis the field has the correct strength and shape, thereby reducing deflection defocusing of the outer beams.

In contrast with the field shapers situated in the system of deflection coils according to Netherlands Patent Application No. 7801317, corresponding to U.S. Pat. No. 4,237,437, field shapers in accordance with the invention, are situated close to the electron beams. Therefore, only a comparatively small part of the deflection field is distorted and only little extra deflection energy is necessary.

The fixed position of the field shapers according to the invention relative to the electron beams also has the advantage that in the case of an error in the positioning of the system of deflection coils, the negative influence on the beams is smaller than in the case of an error in the positioning of a system of deflection coils which itself comprises field shapers.

By manufacturing each field shaper according to the invention from two or three plates, eddy current losses in the field shapers as a result of the second deflection field (the line deflection field) are reduced. By using three plates per field shaper, the slots between the plates of a field shaper are situated further from the electron beams than when two plates per field shaper are used, so that the electron beams experience less distortion as a result of the slots.

Very good results are obtained when the field shapers are situated on parts of one cylinder surface.

BRIEF DESCRIPTION OF THE DRAWING

The invention will now be described in greater detail, by way of example, with reference to the accompanying drawing, in which.

DESCRIPTION OF THE PREFERRED EMBODIMENTS

Figure 1:
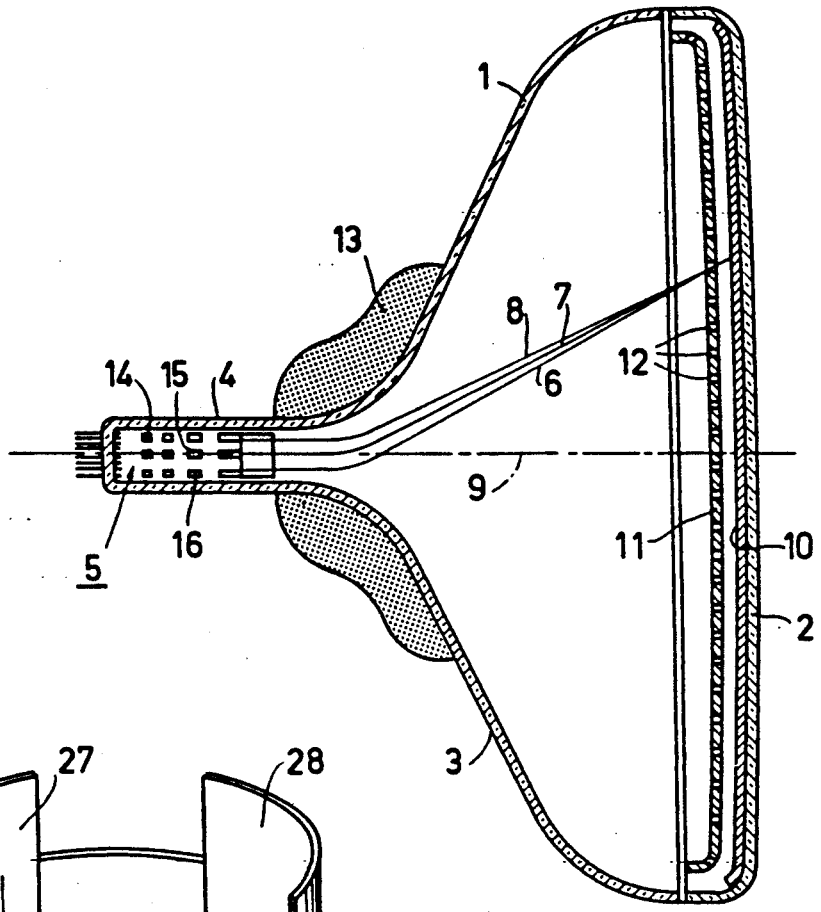
FIG. 1 is a longitudinal sectional view of a colour display tube according to the invention.
Figure 2:
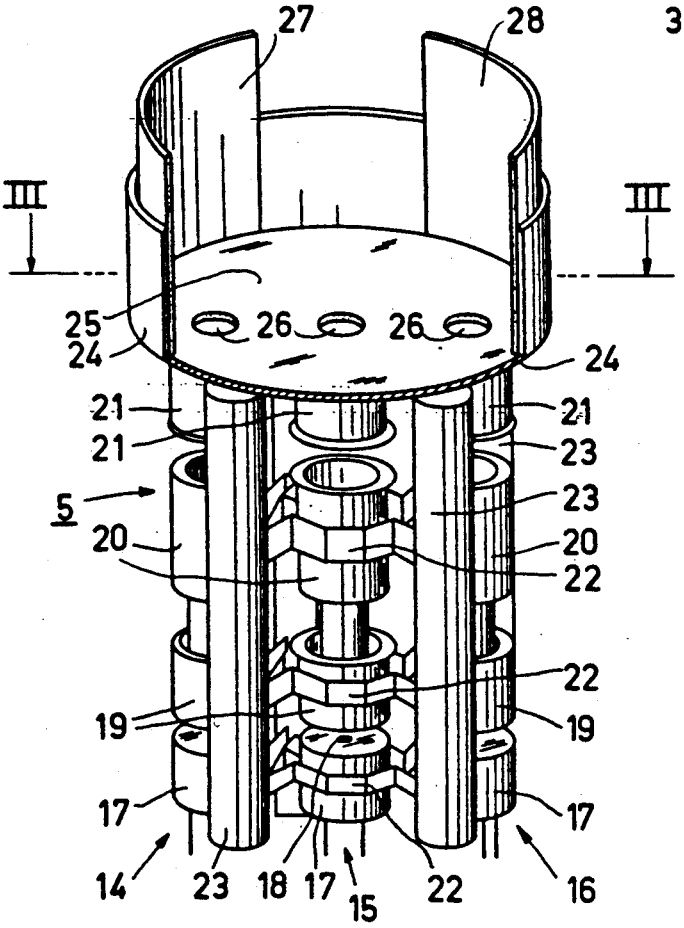
FIG. 2 is an elevation, partly broken away, of an electron gun system as used in the tube shown in FIG. 1.

FIG. 1 is a longitudinal sectional view of a colour display tube of the "in-line" type. A glass envelope 1 including a display window 2, a cone 3 and a neck 4, contains an electron gun system 5 disposed in the neck for producing three electron beams 6, 7 and 8 having their axes situated in one plane (the plane of the drawing). The axis of the undeflected central electron beam 7 coincides with the tube axis 9. The display window 2 comprises on its inside a large number of triplets of phosphor lines. Each triplet comprises a line consisting of a blue-luminescing phosphor, a line consisting of a green-luminescing phosphor, and a line consisting of a red-luminescing phosphor. All triplets together constitute the display screen 10. The phosphor lines are perpendicular to the plane of the drawing. A shadow mask 11, positioned in front of the display screen, includes a multiplicity of elongate apertures 12 through which the electron beams 6, 7 and 8 pass, each impinging only on phosphor lines of one colour. The three coplanar electron beams are deflected by the system of deflection coils 13. In a tube according to the invention, coma correction of the beams is effected without deflection defocusing occurring and without substantially increasing deflection energy. The electron gun system 5 consists of three separate electron guns 14, 15 and 16, as is also shown in FIG. 2 in a broken-away elevation. However, it is also possible to apply the invention to a so-called integrated electron gun system, such as that described, in U.S. Pat. No. 4,196,370, where the electron guns have a number of electrodes in common. The guns 14, 15 and 16 each comprise a control electrode 17 which has an aperture 18. A cathode (not visible) for producing the electron beams is provided opposite to the aperture in the control electrode. Each gun further comprises a second grid 19, a third grid 20 and a fourth grid 21. The grids 17, 19 and 20 are connected to glass rods 23 by means of metal strips 22. The grids 21 are connected against a common cup-shaped electrode 24. The broken-away cup-shaped electrode 24 has a bottom 25 with three apertures 26 through which the electron beams pass. Two field shapers 27 and 28 consisting of curved plates of ferromagnetic material (for example an alloy of 58% by weight of nickel and 42% by weight of iron) are provided against the inner wall of the cup-shaped electrode 24. In this case the plates have a length (measured in the direction of the tube axis 9) of approximately 15 mm. Of course the field shapers may alternatively be provided against the outer wall of electrode 24.

Figure 3:
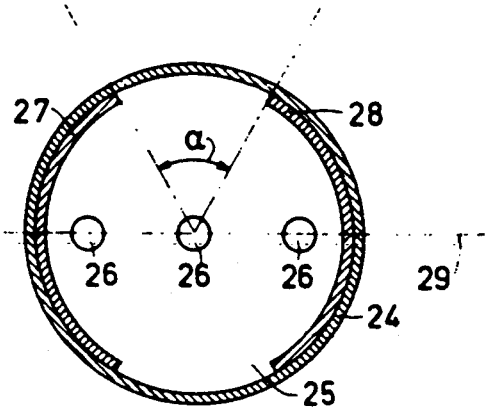
FIG. 3 is a sectional view through FIG. 2, FIGS. 4*a* to *d* explain the operation of prior art field shapers.
Figure 5:
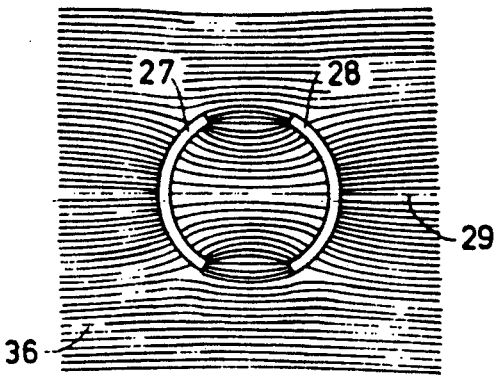
FIG. 5 shows the distortion of the field lines of the frame deflection field by field shapers in accordance with the invention.

FIG. 3 is a sectional view through the cup-shaped electrode of FIG. 2. By a suitable choice of the length of the field shapers measured in the direction of the tube axis and of the angle $\alpha$, the desired extent of field deformation can be adjusted and the line deflection field can also be influenced, if desired. The field shapers are situated symmetrically with respect to the plane through the beam axes, the plane of the drawing of FIG. 1, and symmetrically with respect to the tube axis which coincides with the axis of the central electron beam.

Figure 4A:
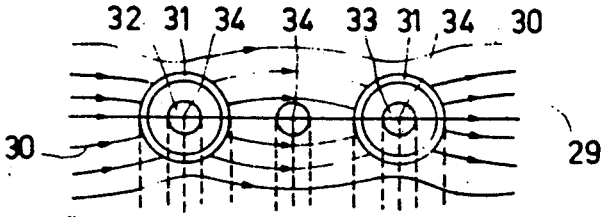
Figure 4B:
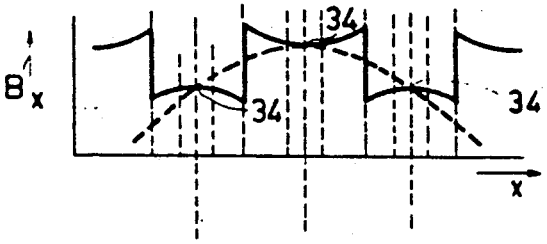
Figure 4C:
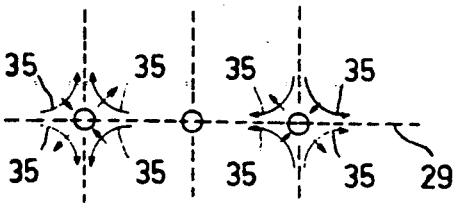
Figure 4D:
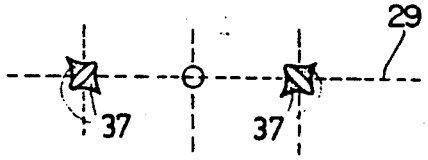

As is shown diagrammatically in FIG. 4*a*, the magnetic field, a number of field lines 30 of which are shown, is obstructed by the prior art rings 31 around the outer electron beams 32 and 33. The resulting field strength variation $B_x$ in the plane through the beam axis 34 is shown in FIG. 4*b* by a solid line. The desired coma-free field is indicated by a broken line. By using the rings 31 the magnetic field $B_x$ at the area of the beam axes 34 is equal to the desired magnetic field and the three rasters written on the display screen are made to coincide. For the electrons in the outer beams 32 and 33 not coinciding with the beam axes, the field does not have the correct field strength variation as a result of which a quadrupole lens action (quadrupole field lines 35) shown in FIG. 4*c* is exerted on the beams, causing deflection defocusing of the outer beams. The radial arrows in FIG. 4*c* denote the forces which act on the beams. The spots on the display screen shown in FIG. 4*d* are elliptical and are surrounded by a haze. The axes of the ellipses in FIG. 4*d* make an angle of 45° with the line 29. The elliptical shape is the result of underfocusing. The dotted haze areas 37 are the result of overfocusing.

By using the field shapers 27 and 28, the frame field, of which a number of field lines 36 are shown, is made pincushion-shaped at the gun end. A pincushion-shaped field consists substantially of a bipolar field having a six-pole component. With such a field, which corresponds to the desired field according to the broken line in FIG. 4*b*, it is possible to eliminate the quadrupole error at the area of the side beams and hence to substantially reduce the deflection defocusing of the beams.

Figure 6:
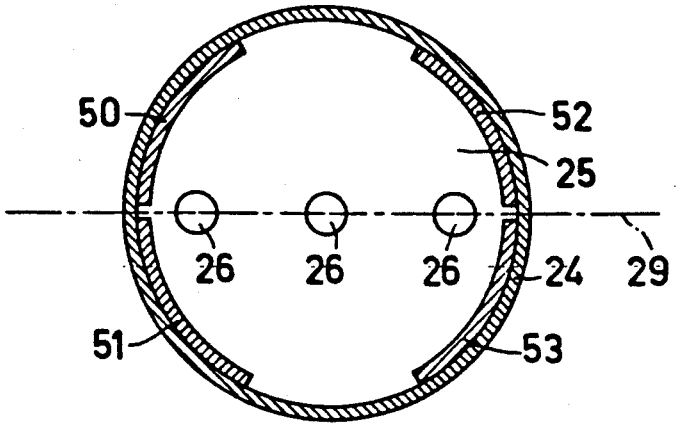
FIGS. 6, 7 and 8 show, in the same manner as in FIG. 3, a number of alternative field shapers.
Figure 7:
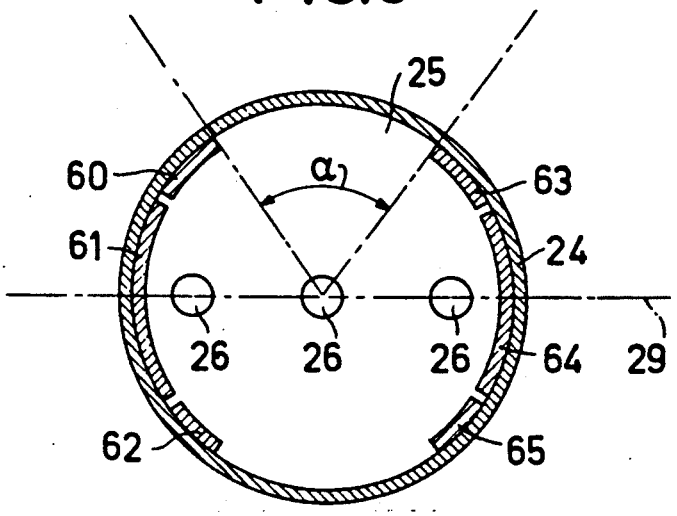

Because the field shapers 27 and 28 are placed closely around the three electron beams, only a comparatively small part of the frame field (horizontal field lines) is distorted as compared with the use of field shapers comprising a system of deflection coils. This means that the use of field shapers according to the invention uses less deflection energy than when using field formers in the system of deflection coils. Moreover, the field shapers are positioned fixedly with respect to the beam axes. By manufacturing each field shaper from two plates 50, 51 and 52, 53 as shown in FIG. 6, or from three plates 60, 61, 62 and 63, 64, 65, as is shown in FIG. 7, eddy current losses in the field shapers as a result of the line deflection field (the second deflection field) are reduced. The use of three plates per field shaper is to be preferred because, as was already indicated, the field distortion caused by the gaps then takes place at a large distance from the beams and the influence on the beams becomes negligible. All field shapers are symmetrical with respect to the plane through the beam axes the line 29 of which in FIGS. 3 to 8 is the line of intersection with the plane of the drawing. By choosing the angle $\alpha$ and the length of the field shapers in the direction of the tube axis, the line deflection field can also be influenced.

Figure 8:
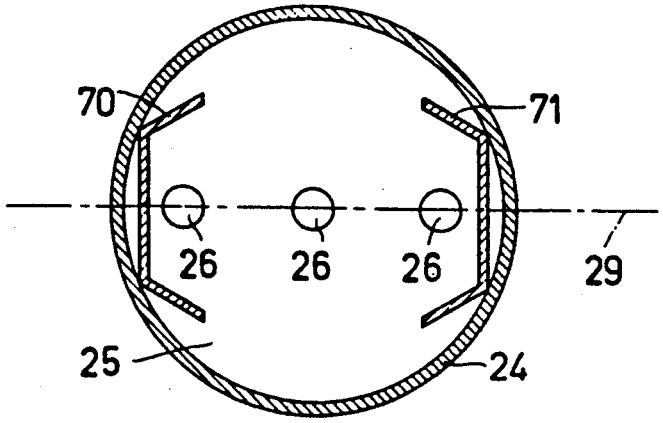

It is not necessary for the field shapers to be provided against the wall of the cup-shaped electrode 24. As shown in FIG. 8, the field shapers 70 and 71 may consist of two bent plates which also distort the magnetic field in a pincushion-shaped manner. The plates may also be curved according to parts of an ellipse.

What is claimed is:

1. A color display tube comprising:

(a) an evacuated envelope having a display window with an inner surface supporting a luminescent display screen;

(b) an electron gun system for producing central and first and second outer electron beams having their axes lying in a longitudinal plane intersecting the display screen, and for converging the electron beams toward a point of coincidence on said display screen;

(c) first and second deflection means disposed around the electron beam axes for producing first and second deflection fields for deflecting the electron beams in a first direction parallel to the longitudinal plane and in a second direction perpendicular to said plane, respectively; and (d) field shaping means, arranged at an end of the electron gun system from which the electron beams exit, for locally distorting at least one of the deflection fields to augment dynamic convergence of the electron beams such that there is coincidence on the display screen of respective rasters produced by said electron beams;

characterized in that the field shaping means comprises a pair of first and second ferromagnetic plate means arranged symmetrically with respect to both the longitudinal plane and the central beam axis, each of said first and second plate means intersecting said plane outside of a respective one of the first and second outer electron beams and being shaped such that it has ends which diverge from the longitudinal plane and partially surrounds the respective outer electron beam;

said first and second plate means serving to distort the second deflection field, where the electron beams enter said field, such that said field is pin-cushion-shaped and comprises a substantially bipolar field having a six-pole component;

said distorted field effecting coincidence of said rasters without substantially defocusing the electron beams.

2. A color display tube as in claim 1 characterized in that each of said ferromagnetic plate means comprises a plurality of separate plates.

3. A color display tube as in claim 2 where each of said ferromagnetic plate means comprises two plates.

4. A color display tube as in claim 2 where each of said ferromagnetic plate means comprises three plates.

5. A color display tube as in claim 1 or 2 where the electron gun system includes a cylindrical member surrounding the electron beam axes and where the ferromagnetic plate means are disposed on an inner surface of said cylindrical member.

6. A color display tube comprising:

(a) an evacuated envelope having a display window with an inner surface supporting a luminescent display screen;

(b) an electron gun system for producing central and first and second outer electron beams having their axes lying in a longitudinal plane intersecting the display screen, and for converging the electron beams toward a point of coincidence on said display screen;

(c) first and second deflection means disposed around the electron beam axes for producing first and second bipolar deflection fields for deflecting the electron beams, the first deflection field having lines of flux extending in a first direction generally parallel to the longitudinal plane, and the second deflection field having lines of flux extending in a second direction generally perpendicular to said plane; and (d) field shaping means, arranged at an end of the electron gun system from which the electron beams exit, for causing rasters written on the display screen by the electron beams to substantially coincide;

characterized in that the field shaping means comprises a pair of first and second ferromagnetic plate means arranged symmetrically with respect to both the longitudinal plane and the central beam axis, each of said first and second plate means being arranged outside the beam paths of the respective first and second outer electron beams, and each of the first and second plate means being of generally concave form such that it is divergent relative to the longitudinal plane and partially surrounds the respective outer electron beam;

said first and second plate means serving to modify the bipolar field of the first deflection means with a six-pole component so that at least between the plate means the modified field is of pin cushion shape;

said modified field effecting coincidence of the rasters without substantially defocusing the electron beams.

7. A colour display tube as in claim 6 characterized in that each of said ferromagnetic plate means comprises a plurality of separate plates.

8. A colour display tube as in claim 7 where each of said ferromagnetic plate means comprises two plates.

9. A colour display tube as in claim 7 where each of said ferromagnetic plate means comprises three plates.

10. A colour display tube as in claim 6 or 7 where the electron gun system includes a cylindrical member surrounding the electron beam axes and where the ferromagnetic plate means are disposed on an inner surface of said cylindrical member.

* * * * *